US006105844A

United States Patent [19]

Walters et al.

[11] Patent Number: 6,105,844

[45] Date of Patent: Aug. 22, 2000

[54] COOLER

[75] Inventors: Richard S. Walters, Port Washington; Raymond H. Klein, Milwaukee, both of Wis.; T. Brent Freese, Gurnee, Ill.; Scott H. Micoley, Cedarburg; Scott G. Klos, Grafton, both of Wis.

[73] Assignee: Outer Circle Products, Ltd., Chicago, Ill.

[21] Appl. No.: 09/081,894

[22] Filed: May 20, 1998

[51] Int. Cl.[7] ..... A45F 3/02

[52] U.S. Cl. ..... 224/610; 224/148.7; 62/457.1; 62/457.7; 220/23.83; 220/23.86; 220/915.2; 206/541; 206/545; 206/547; 206/549

[58] Field of Search ..... 224/148.1, 148.4, 224/148.7, 610, 645, 650, 651, 652, 680, 246, 926, 628, 629; 62/457.1, 457.7; 220/23.4, 23.83, 23.86, 592.25, 915.2; D07/605, 606, 608; 206/541, 547, 549; 190/109, 111

[56] References Cited

U.S. PATENT DOCUMENTS

| | | | |
|---|---|---|---|
| D. 307,093 | 4/1990 | Kobayashi | D7/605 |
| D. 386,360 | 11/1997 | Krug, Sr. | D7/605 |
| 2,858,957 | 11/1958 | Darrah | 220/23.4 |
| 3,610,409 | 10/1971 | Graf | 220/23.4 X |
| 4,303,109 | 12/1981 | Cohen | 224/926 X |
| 4,541,540 | 9/1985 | Gretz et al. | 220/915.2 X |
| 4,571,740 | 2/1986 | Kirby et al. | 62/457.1 X |
| 4,640,392 | 2/1987 | Decker, Jr. et al. | 220/23.83 X |
| 4,648,512 | 3/1987 | Tarozzi et al. | 206/541 X |
| 5,230,450 | 7/1993 | Mahvi et al. | 220/23.4 X |
| 5,318,084 | 6/1994 | Jackson | 224/578 X |
| 5,407,218 | 4/1995 | Jackson | 62/457.7 X |
| 5,524,761 | 6/1996 | Wayman | 206/541 X |
| 5,971,200 | 10/1999 | Reynolds | 220/23.83 X |

FOREIGN PATENT DOCUMENTS

| | | | |
|---|---|---|---|
| 56775 | 7/1982 | European Pat. Off. | 206/541 |
| 835030 | 12/1938 | France | 190/109 |
| 947217 | 6/1949 | France | 190/109 |
| 2549354 | 1/1985 | France | 206/541 |

OTHER PUBLICATIONS 1988 catalog by Canadian Thermos Products, Ltd., p. 5.

Thermos "Weekend" Cooler as shown in Exhibits A and B, including product literature (no date provided).

*Primary Examiner*—Gregory M. Vidovich

*Attorney, Agent, or Firm*—McDonnell Boehnen Hulbert & Berghoff

[57] ABSTRACT

The present invention comprises a portable, insulated carrier having a generally rigid housing defining a primary insulated compartment. An auxiliary storage assembly is attached to the housing for retaining an article on the housing externally of the primary insulated compartment. The auxiliary storage assembly includes a ledge and a retainer whereby the article abuts the ledge and is retained against the housing by the retainer. A secondary storage assembly is attached to the outside surface of the housing externally of the primary insulated compartment. The secondary storage assembly is formed of a flexible material to secure the contents yet provide access when necessary. An article retention assembly is attached to an outside surface of the housing. The retention assembly includes a generally elastic panel portion attached to an exterior surface of the housing with at least one edge thereof defining an opening for receiving articles therethrough.

16 Claims, 7 Drawing Sheets

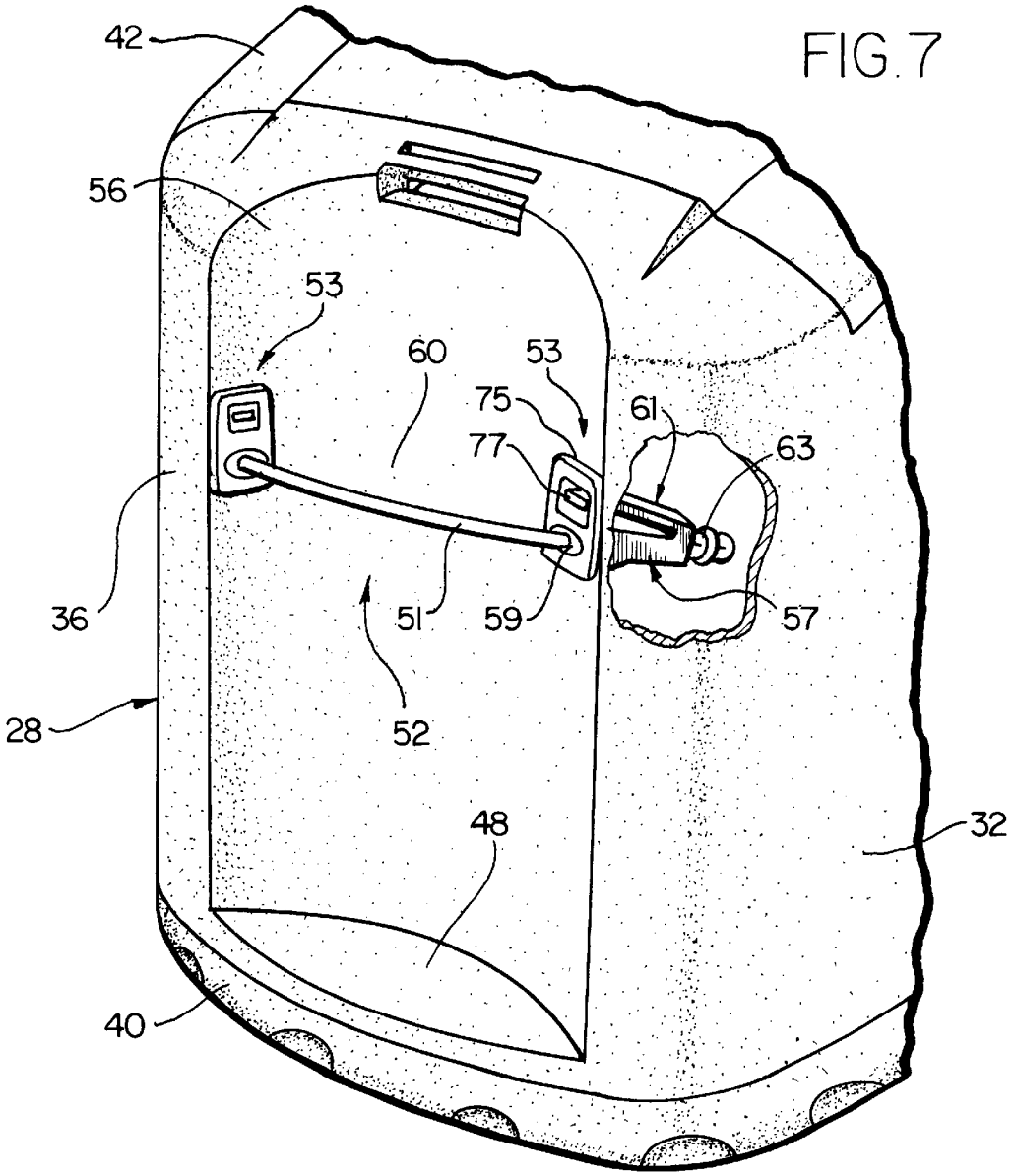
FIG. 7
FIG. 8
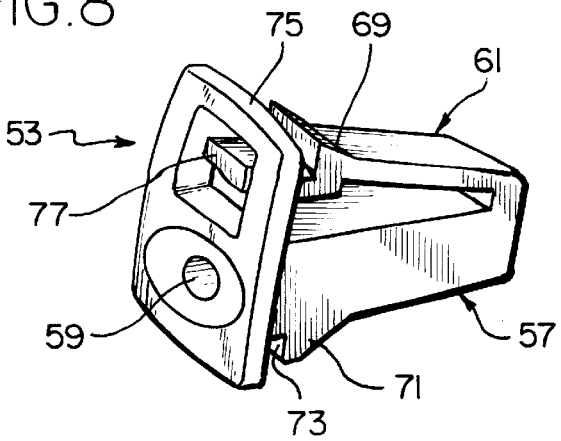

COOLER

BACKGROUND

The present invention relates to insulated carriers for holding articles such as food and food containers which minimizes the heat transfer between the articles held inside the carrier and the ambient environment. Often times, such insulated carriers are referred to as "coolers" because they are often used to carry chilled or frozen items.

A variety of coolers are available. For example, U.S. Pat. No. 5,403,095, assigned to the assignee of the present invention, Outer Circle Products, Ltd., shows a generally flexible cooler having a rigid liner therein. Another form of cooler currently available is a rigid cooler which is formed of a rigid plastic material. While each of these types of coolers provide many advantages, it would be desirable to provide a generally rigid cooler having characteristics of the soft cooler to satisfy various desirable characteristics.

By way of example, the rigid coolers provide satisfactory temperature maintenance. However, everything must be carried within the rigid cooler because additional storage compartments are not provided. Moreover, the rigid coolers do not provide additional storage compartments which are individually accessible. As a result, all of the items must be carried within the rigid cooler. This is undesirable such that access to items which may not need to be insulated causes the cooler to be opened when such items are needed. As a result, the insulating characteristics of the rigid cooler are compromised. For example, if a user wants to carry a bottle of sunscreen and sunglasses, they must either find an available personal clothing pocket or carry the items within the cooler. Because items such as sunscreen bottles are bulky and glasses are delicate, they are often carried within the cooler instead of a pocket on the user's clothing. As a result, when the user wishes to apply sunscreen or put on their sunglasses, they must open the cooler to take these items out. As a result, warm air will enter the cooler thereby reducing the insulating efficiency of the cooler and shortening the period during which items within the cooler will stay cool. Additionally, the cooler does not provide protection for such items and may result in the items becoming wet or damaged because ice is often carried within the cooler.

In a similar manner, the prior art coolers do not provide for attachments for auxiliary vessels such as thermos bottles or beverage bottles. As mentioned above, prior art coolers typically provide one compartment in which all items must be placed. Because items such as thermos bottles and beverage bottles may not need to be cooled, it would be desirable to provide access to such items externally of the cooler compartment. This is especially true in the case of thermos bottles, because thermos bottles provide their own insulation and therefore do not need to occupy the space within the cooler in order to maintain a desired temperature.

OBJECTS AND SUMMARY

A general object of the present invention is to provide a portable insulated carrier, a "cooler", which provides multiple, independently accessible storage areas.

Another object of the present invention is to provide an auxiliary storage area to retain an article on the cooler externally of a primary insulated compartment.

A further object of the present invention is to provide a portable insulated carrier which includes a secondary storage area externally of a primary storage compartment which segregates articles not needing the insulating characteristics of the primary compartment.

Yet a further object of the present invention is to provide a portable insulated carrier which includes an article retention structure externally of a primary compartment and which is accessible independently of the primary insulated compartment.

Briefly, and in accordance with the foregoing, the present invention comprises a portable, insulated carrier having a generally rigid housing defining a primary insulated compartment. An auxiliary storage assembly is attached to the housing for retaining an article on the housing externally of the primary insulated compartment. The auxiliary storage assembly includes a ledge and a retainer whereby the article abuts the ledge and is retained against the housing by the retainer. A secondary storage assembly is attached to the outside surface of the housing externally of the primary insulated compartment. The secondary storage assembly is formed of a flexible material to secure the contents yet provide access when necessary. An article retention assembly is attached to an outside surface of the housing. The retention assembly includes a generally elastic panel portion attached to an exterior surface of the housing with at least one edge thereof defining an opening for receiving articles therethrough.

BRIEF DESCRIPTION OF THE DRAWINGS

The organization and manner of the structure and function of the invention, together with the further objects and advantages thereof, may be understood by reference to the following description taken in connection with the accompanying drawings, wherein like reference numerals identify like elements, and in which:

FIG. 7 is an enlarged perspective end view of an auxiliary storage assembly of the present invention showing a partial fragmentary section through a housing thereof to show a position of a strap anchor;

FIG. 8 is an enlarged perspective view of the strap anchor as shown in FIG. 7;

DESCRIPTION

Figure 1:
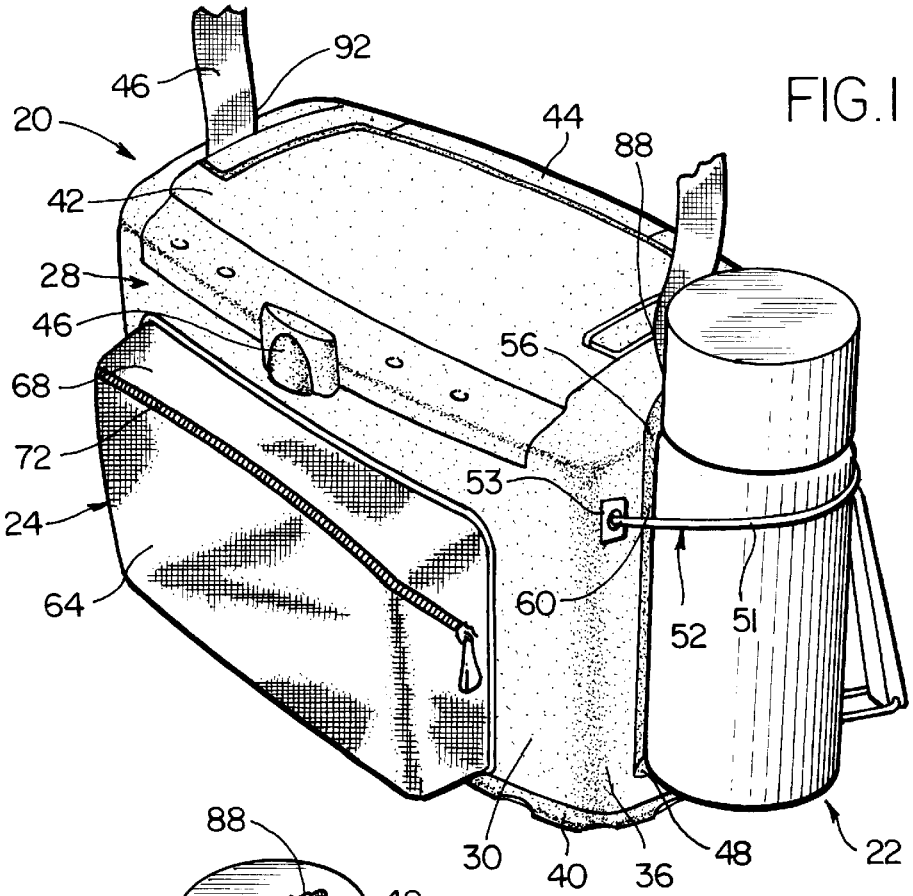
FIG. 1 is a front, right side perspective view of a portable insulated carrier of the present invention.
Figure 2:
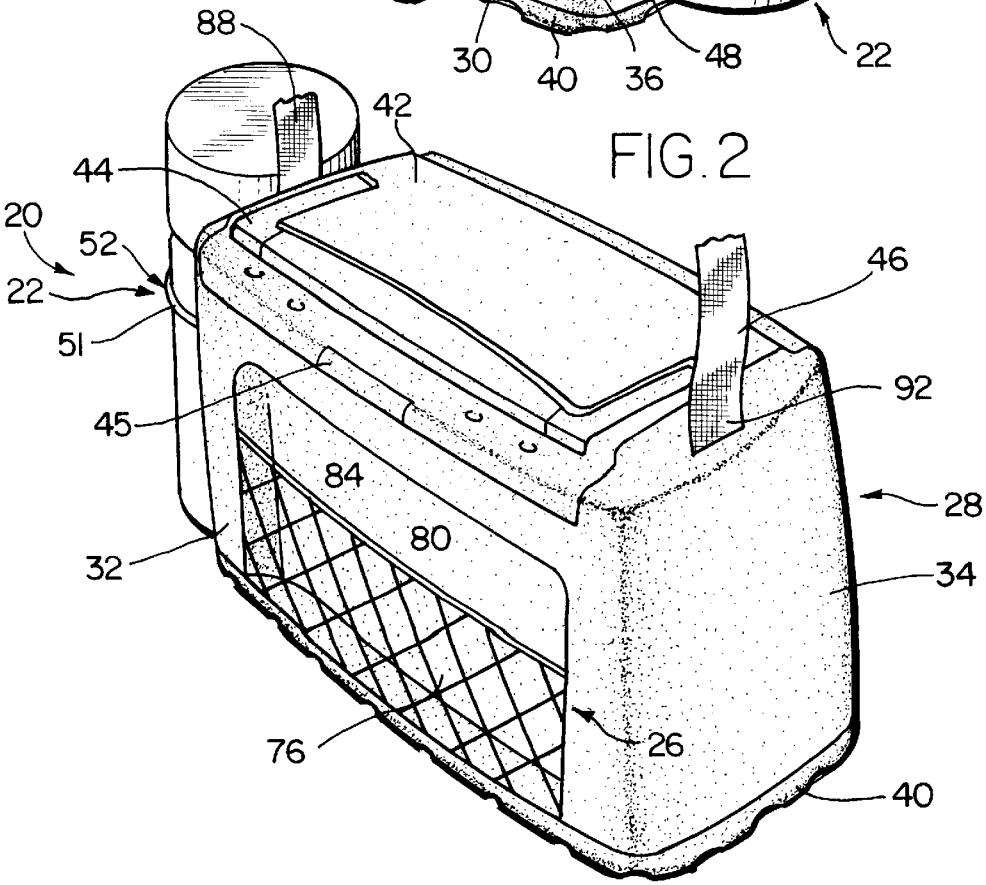
FIG. 2 is a rear left side perspective view of the cooler in FIG. 1.

While the present invention may be susceptible to embodiment in different forms, there is shown in the drawings, and herein will be described in detail, an embodiment with the understanding that the present description is to be considered an exemplification of the principles of the invention and is not intended to limit the invention to that as illustrated and described herein.

As shown in FIG. 1, the present invention is a portable, thermally insulating carrier 20. It should be noted that while a preferred embodiment of the invention anticipates a thermally insulating carrier to generally maintain the temperature of items retained inside the carrier, other carriers which may not have the same insulating capabilities may also achieve the claimed invention. The various aspects of the invention may also be achieved with a generally un-insulated carrier.

Figure 3:
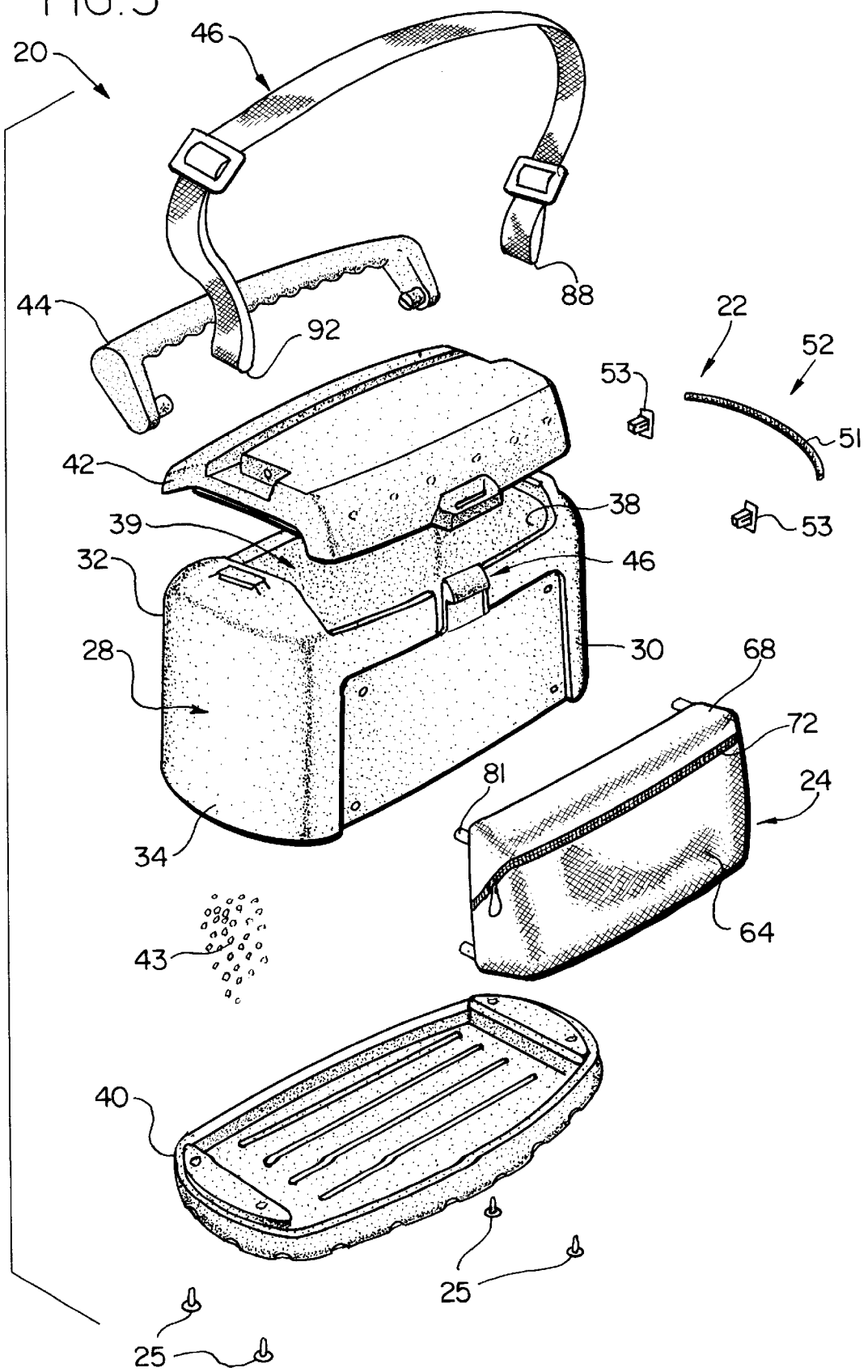
FIG. 3 is an exploded perspective view thereof.
Figure 4:
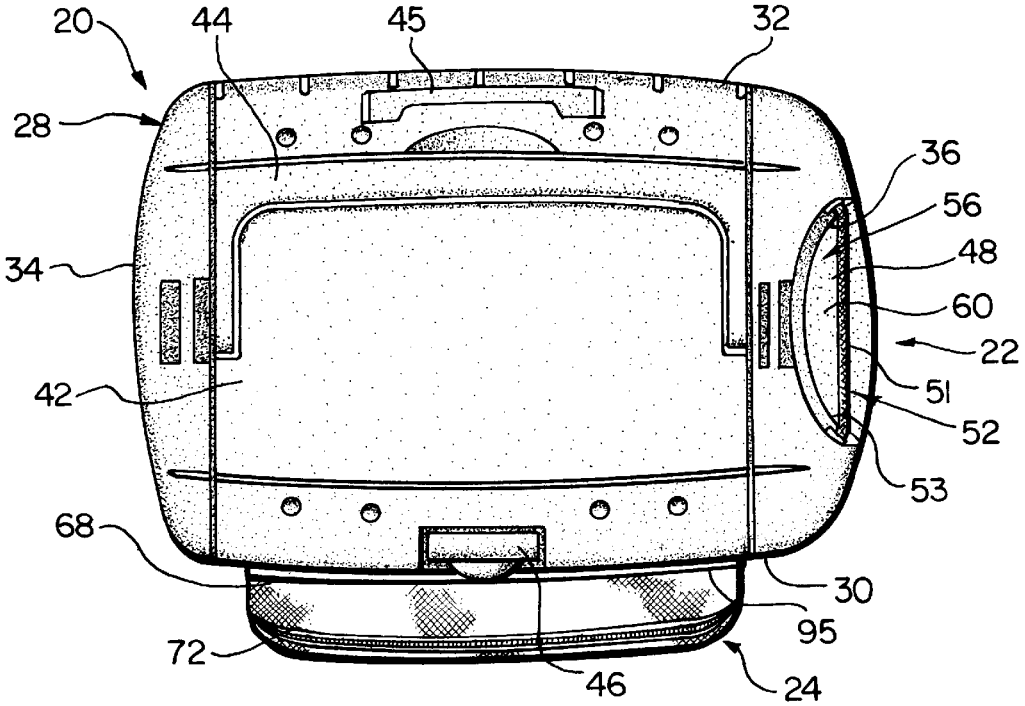
FIG. 4 is a top plan view thereof.
Figure 5:
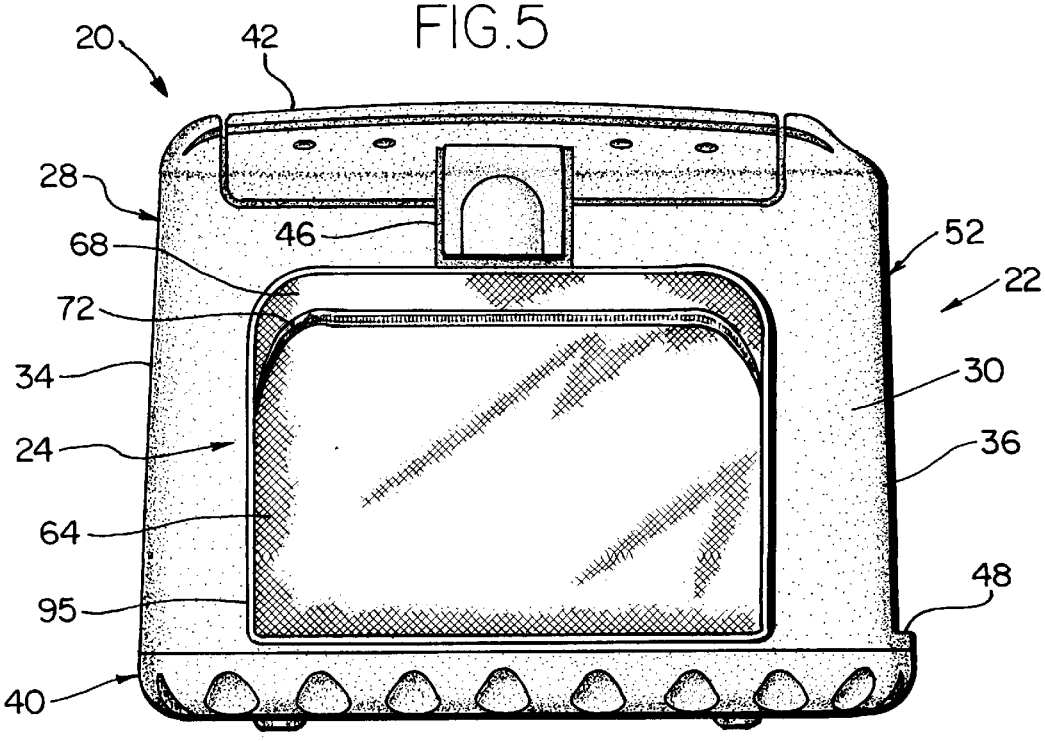
FIG. 5 is a front elevational view thereof.

The carrier 20 includes an auxiliary storage assembly 22, a secondary storage compartment 24 and an article retaining assembly 26 (as better shown in FIG. 4). Each of these aspects of the invention will be described in greater detail hereinbelow. The carrier 20 includes a housing 28 which is a generally rigid structure comprising exterior walls, namely, a front wall 30, a rear wall 32, a left side wall 34, and a right side wall 36. A hollow, tub-like liner 38 is positioned interiorly of the four walls 30, 32, 34, 36 defining a primary compartment 39 (See FIG. 3) therein. The liner 38 is a generally rigid structure and may be integrally formed with the four walls 30, 32, 34 and 36. A hollow cavity 41 (See FIG. 11) is defined between the liner 38 and the walls 30, 32, 34, 36 which can be filled with an insulating material 43 such as insulating foam beads, a pre-formed insulating insert block or foamed-in-place foam material. After the insulation 43 is inserted into the cavity 41, a base 40 is attached thereto.

A cover or lid 42 is provided and attached to the housing 28 by a hinge 45. A handle 44 is attached to the lid 42. A closing latch 46 is provided on the lid 42 and housing 28 to retain the lid 42 in a covering position over the primary compartment 39 defined by the liner 38. A shoulder strap 46 is attached to the housing 28.

Figure 6:
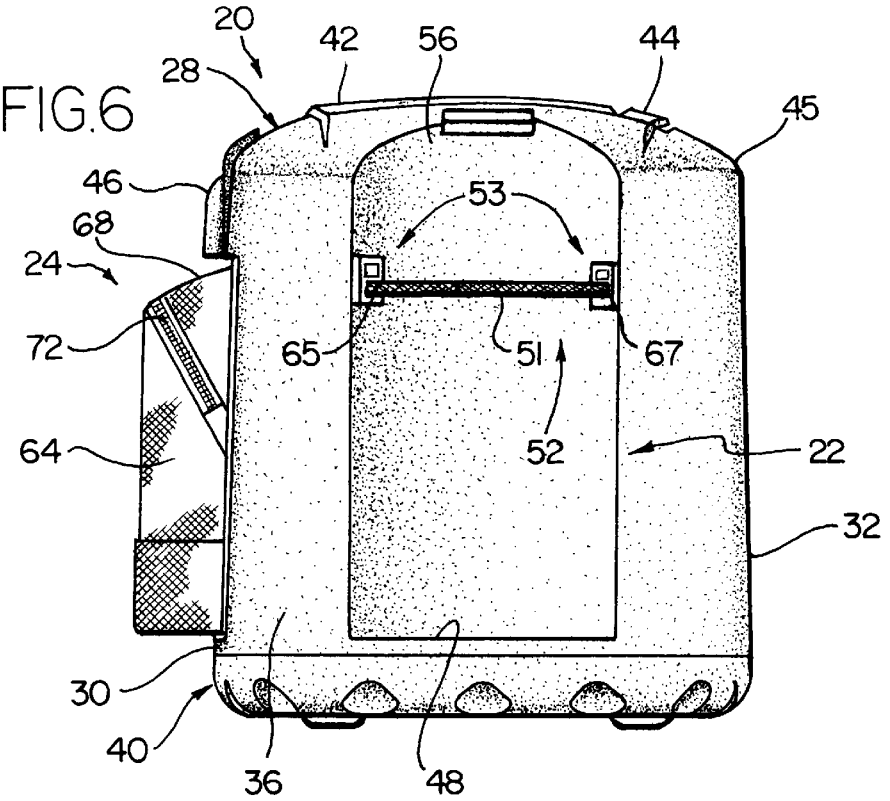
FIG. 6 is a side elevational view thereof showing a side view of an auxiliary storage area.

Having now described the overall structure of the carrier 20, we now turn to the previously introduced auxiliary storage assembly 22. As shown in FIGS. 1, 3–9, the auxiliary storage assembly 22 allows an article such as a thermos or water bottle to be retained on the carrier 20 exteriorly of the housing 28. As shown in the preferred embodiment in the illustrations, the auxiliary storage assembly 22 includes a ledge 48 and a retainer 52. As shown in FIG. 6, the ledge 48 is formed in a recessed area 56 of an end wall 36 of the housing 28. The ledge 48 is defined as a surface resulting from a portion of the recessed area 56 above the base 40. It should be understood that the ledge or platform 48 could also be formed extending from the wall 36 without providing the recessed area 56.

The retainer 52 is shown as a single generally elastic band or strap. It should be understood that a variety or a plurality of retainers 52 may be provided in the invention. For example, a portion of generally elastic mesh material may be attached to the housing defining a receptacle 60 in the manner as shown in the drawings. Furthermore, multiple retainers 52 may be attached to the carrier.

The object of the auxiliary storage assembly 22 is to provide a position in which an article can be secured outside of the carrier housing 28 by providing a ledge 48 and a retainer 52 defining a receptacle 60 therebetween. The auxiliary storage assembly 22 is an appropriate place to store a thermos such that the thermos need not unnecessarily occupy the space in the compartment 39 which might otherwise be used for other items. Moreover, a thermos is insulated without the need for additional insulation from the carrier 20. Furthermore, because the article is carried on the outside of the carrier 20, the lid 42 does not need to be opened and therefore the thermal insulating effect of the carrier 20 is enhanced.

The retainer 52 as shown in the drawings of FIGS. 1–9 and 12 uses an elastic cord often referred to as a "bungie" cord. The bungie cord provides elastic retaining forces to hold the article against the housing 28 and on the ledge 48. The embodiment as shown herein employs a specific retainer anchor 53. The retainer anchor 53 is positioned through a hole 55 through the wall of the housing 28. The anchor 53 is removable to allow for replacement of the cord 51 in the event it becomes damaged or broken.

Figure 9:
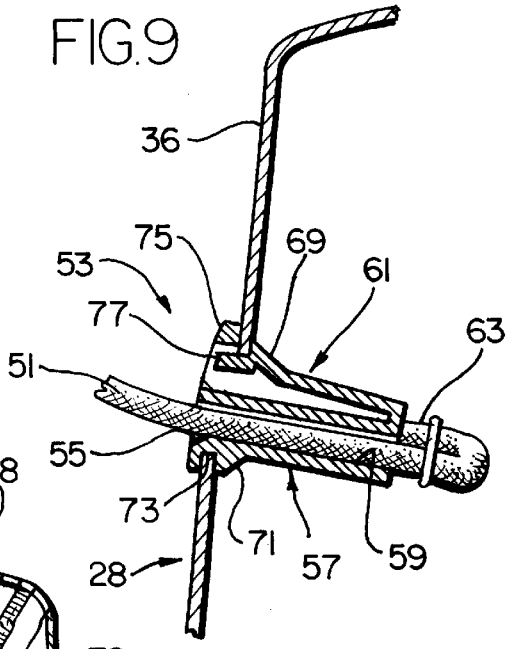
FIG. 9 is a partial fragmentary, cross-sectional side elevational view of the anchor attached to the wall as shown in FIG. 7.

As shown in FIGS. 7–9, the anchor includes a body portion 57 defining a passage 59 therein. A locking finger 61 is provided on the body 57 to provide a biased engagement of the anchor 53 in the hole 55. The cord 51 is inserted through the passage 59 of the body 57 with a free end 63 thereof being knotted or bound to prevent removal from the passage 59. Each end 65,67 (See FIG. 6) of the cord 51 is attached to an anchor 57.

Each anchor 57 is inserted through a corresponding hole 55 in the housing 28. When inserting an anchor 57 through the hole 55, the locking finger 61 is compressed towards the body 57 permitting passage through the hole 55. After tapered surfaces 69, 71 on the locking finger 61 and body 57, respectively, are inserted through the hole, the locking finger biasedly moves away from the body 57 providing retention of the anchor 53 in the hole 55.

When the anchor 53 is engaged in the hole 55, a channel 73 of the body 57 engages an edge of the hole 55. Similarly, a front flange 75 proximate to the locking finger 61 and a portion of the tapered surface 69 cooperatively engage in opposing edge of the hole 55. The tension of the cord 51 in a resting state helps to prevent accidental disengagement of the anchor 53 from the hole 55. This tension, of course, is increased when an object is placed between the cords 51 and the housing 28.

If a cord becomes damaged or broken, a grip portion 77 which is exposed to access is urged towards the body 57 to disengage the finger 61 from the edge of the hole 55. The channel 73 can then be disengaged from the opposing edge of the hole 55 allowing for removal of the anchor 55 from the hole. A new bungie cord is then attached to the anchor as described above and the anchor is reinserted into the hole.

It should be noted that other forms of attaching a bungie can be used to achieve the present invention. For example, holes can be provided to allow a standard bungie having J-hooks on the end thereof to be attached to the housing 28. In this regard, the J-hook would be attached to a hole on the housing to secure the bungie cord thereto.

Turning now to the secondary storage compartment 24, it is illustrated as a flexible material pocket positioned on the outside of the front wall 30 of the housing 28. The secondary storage compartment 24 includes a pouch portion 64, a cover portion 68 and a closure 72 connecting the cover to the pocket to retain articles within the secondary compartment 24. It is desirable to provide a secondary storage compartment 24 for the present invention so that articles do not have to be retained within the primary compartment 39 of the carrier. As mentioned above in the background section, articles such as sunscreen and sunglasses are often carried by individuals and need to stored somewhere. Sunscreen containers are bulky and sunglasses are delicate and therefore it is undesirable to carry such items in a clothing pocket. It is also undesirable to carry such things within the primary compartment such that if the compartment is being used to maintain chilled items, such articles may become wet or damaged within the primary compartment. Moreover, articles such as sunglasses can be rather expensive and it is desirable to provide a closed compartment for such articles. The secondary storage compartment 24 of the present invention provides the conveniences required. Moreover, it positions the storage compartment on the rigid housing 28 so that all of the necessary articles carried by an individual are in one place and in one carrier for convenience.

It is also desirable to form the secondary storage compartment 24 of a light flexible material so that it does not add appreciable weight to the overall carrier assembly. It should be noted that the generally rigid structure of the housing 28 may be provided from a molded plastic material. The combination of the housing 28, lid 42, and all the necessary hardware add to the weight of the carrier 20. As such, because the secondary storage compartment 24 is intended to be used for items which do not need to be insulated, a light flexible material such as nylon, sheet PVC or other suitable material may be used.

Figure 11:
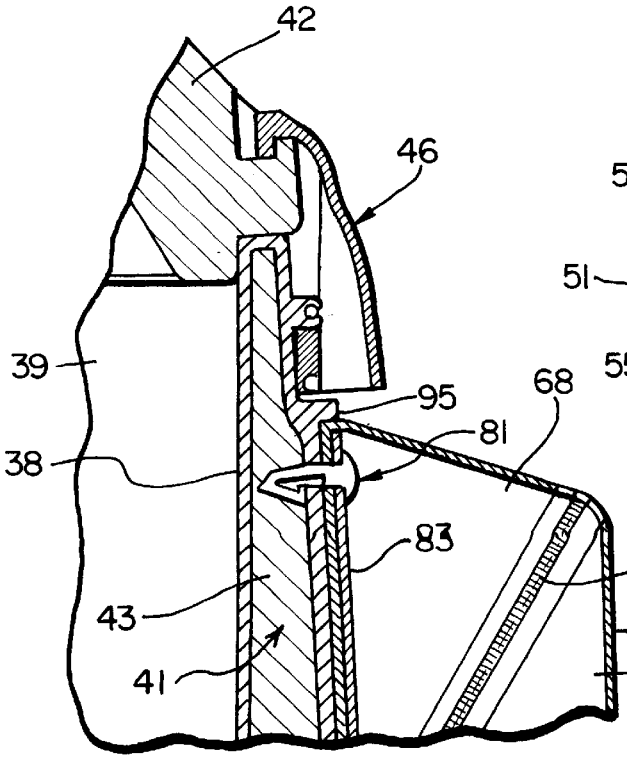
FIG. 11 is an enlarged, partial fragmentary, side elevational view of a portion of the secondary storage compartment as shown in FIG. 10 providing an enlarged detail of the attachment of the compartment to the housing.
Figure 10:
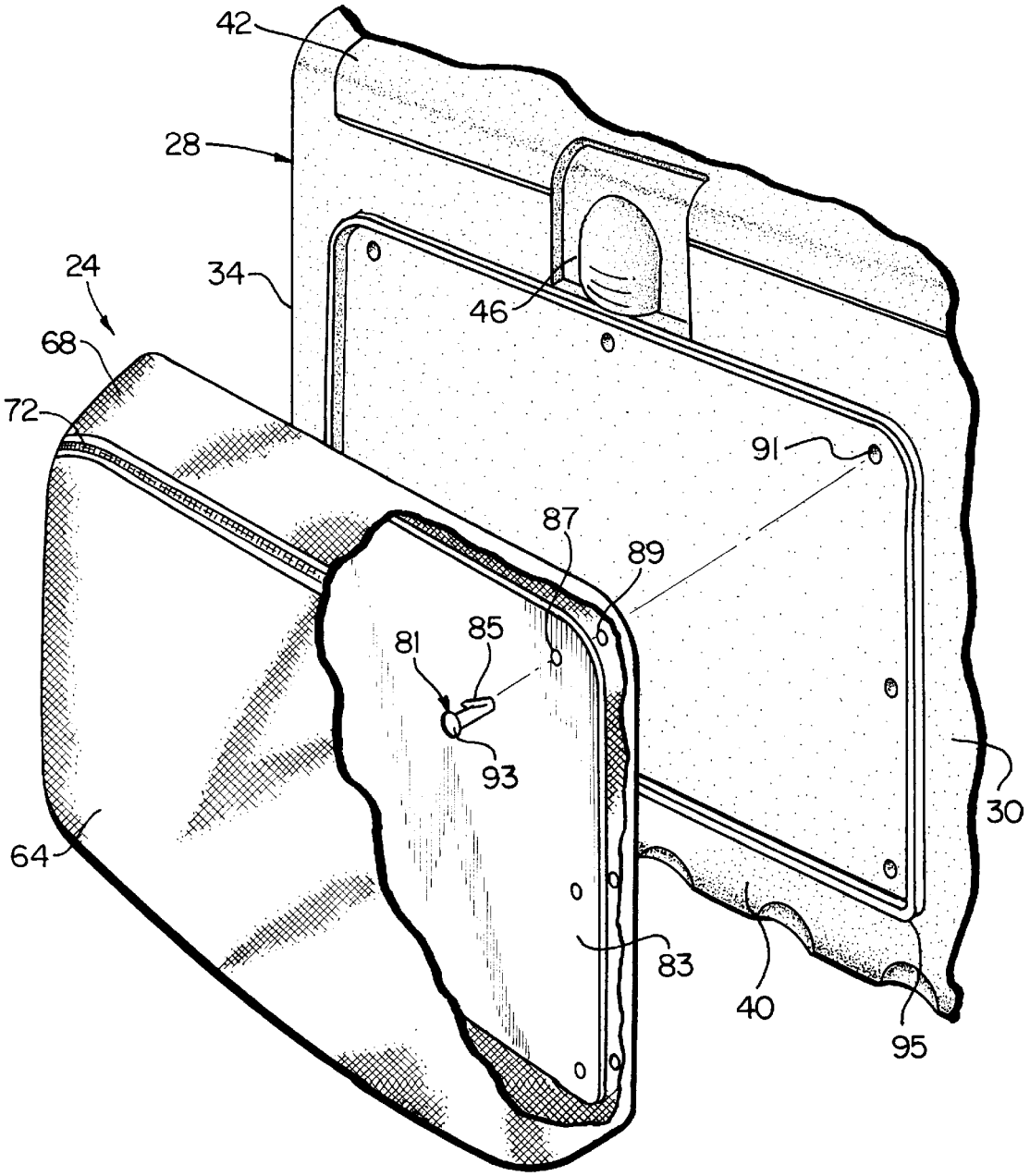
FIG. 10 is an enlarged, partial fragmentary, perspective view of a secondary storage compartment which attaches to a front surface of the housing of the cooler.

With reference to FIGS. 1, 3–6, 10 and 11, the secondary storage compartment 24 is attached to the side of the housing 28 using blind fasteners 81. As shown in FIG. 10, the pocket portion 64 and cover 68 are formed of a fabric material. A rigid retaining panel 83 is positioned on the inside of the pouch and cover 64, 68. The blind fastener as shown in FIGS. 10 and 11 is a type such as a sure-lock or Christmas tree-type fastener. An enlarged engaging portion 85 is inserted through an aperture 87 on the panel 83, through a corresponding hole 89 of the fabric of the compartment, and subsequently through a hole 91 in the housing 28. A head 93 of the fastener 81 overlies the area of the panel 83 surrounding the hole 87 to hold the secondary storage compartment 24 on the housing 28.

As shown in FIG. 10, a lip 95 is provided on the housing to help locate the compartment on the housing. The lip 95 defines an area which is slightly larger than the panel 83 thereby assuring that the compartment 24 will be properly positioned on the housing. Also, the lip 95 and edge of the panel 83 help to further secure the fabric of the compartment 24 on the carrier 20.

It should be noted that other forms of attaching the compartment 24 to the housing 28 may be devised. For example, an adhesive may be used to attach the fabric of the compartment 24 to the housing 28 as well as directly sewing the fabric to the housing. The structure and method of attaching the compartment 24 to the housing as described and shown herein provides an efficient, cost effective and reliable means of securing the compartment 24 to the housing 28.

The article retention assembly 26 is provided as an additional storage area on the carrier 20 of the present invention. It is desirable to provide such an article retention assembly 26 to carry a variety of items which may not need to be insulated but may be too large or need to be readily accessible and therefore generally not suitable for storage in the secondary storage compartment. For example, a tradesman using the carrier of the present invention for a lunch container may find it desirable to carry a newspaper. When the carrier 20 of the present invention is used at a job site, it is desirable to minimize the number of containers and loose articles carried thereby freeing the tradesman's hand while walking through and negotiating obstacles in the job site. The article retention assembly 26 of the present invention provides a storage location for articles such as a newspaper. As an additional example, an individual using the carrier of the present invention for a picnic may find it desirable to place various items such as napkins, corkscrews and other items which are not likely to be damaged, are too bulky to be stored in the secondary compartment 24 and do not require insulated containment.

The article retention assembly 26 of the present invention includes a generally flexible panel 76 attached to the housing. As shown in FIG. 4, the panel 76 is attached on three sides leaving one edge 80 thereof to define an opening 84. The panel 76 is a generally elastic material such as elastic cord mesh, spandex or another elasticized fabric. Such material used for the panel 76 maintains the panel in a flat generally planar condition when not in use, but readily allows for expansion to accommodate a variety of object sizes and shapes. While a portion of the edge 80 may also be attached to the housing 28, at least a portion allows access to position articles in the area defined between an inside surface of the panel 76 and an outside surface of the housing 28.

The configuration of the auxiliary storage assembly 22, secondary storage compartment 24 and article retention assembly 26 is desirable. Moreover, the shoulder strap 46 is positioned with a first end 88 attached in close proximity with the auxiliary storage assembly 22. The second end 92 of the shoulder strap 46 is attached at a position spaced away from the auxiliary storage assembly 22. The shoulder strap 46 is generally oriented perpendicular to the auxiliary storage assembly 22. As a result, the strap 46 is generally oriented parallel to the secondary storage compartment 24 and the article retention assembly 26. This arrangement of structures allows the carrier 20 to be carried over a user's shoulder by using the strap 46. The article retention assembly 26 can then be positioned against the user's body with the secondary storage compartment 24 positioned on the outside. This orientation prevents damage to any articles carried in the secondary storage compartment 24 since they will not be forced against the user's side by the weight of the carrier 20 and its contents. Moreover, the auxiliary storage assembly 22 is positioned on an end to similarly be positioned away from the user so as to prevent any discomfort while carrying the carrier 20. It should be noted that the shoulder strap was omitted from FIGS. 4–7 for clarity.

Figure 12:
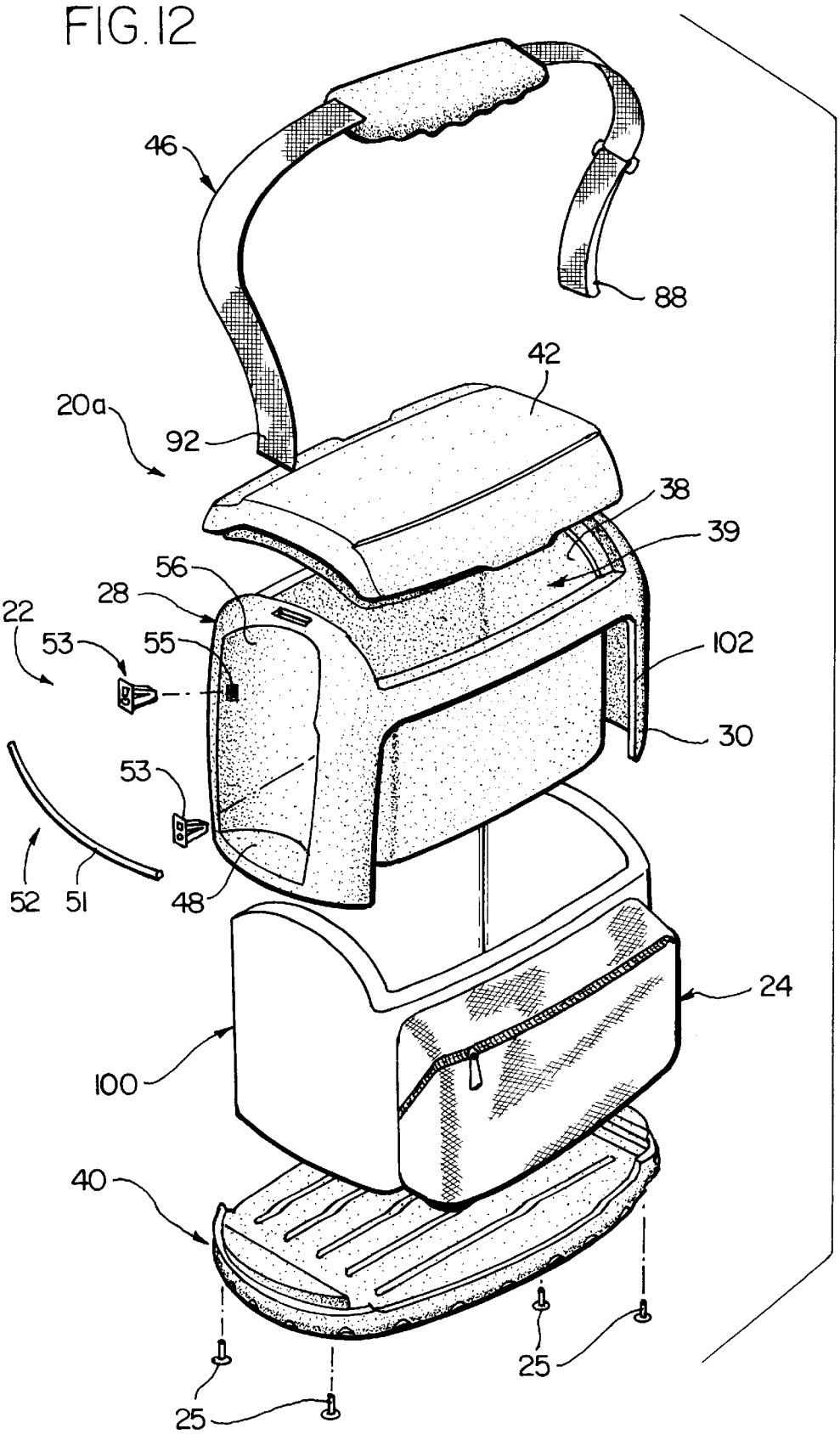
FIG. 12 is an exploded perspective view of an alternate embodiment of the present invention.

FIG. 12 provides an alternate embodiment of the invention as substantially described hereinabove. In FIG. 12, the auxiliary storage assembly 22 is provided having the same construction thereof. Similarly, the general structure of the housing 28, base 40, shoulder strap 46 and lid 42 are essentially the same. The alternate embodiment as shown in FIG. 12 is different from the invention as described hereinabove such that the insulation is provided by way of a sewn flexible insulating member 100. This insulating structure 100 can be inserted in the cavity 43 in a similar manner as shown in FIG. 11. The insulating structure 100 does not need to be specifically molded or formed to comply with the various curves and dimensions in the cavity. Rather, since it is a flexible fabric type material which is also compressible to some degree, it can be slide into position in the cavity 43. Once the insulating structure 100 is properly positioned, the base 40 is attached by way of the fasteners 25 as described hereinabove.

The secondary compartment 24*a* as shown in FIG. 12 is nearly identical to the secondary compartment as shown in the proceeding figures. However, in this alternate embodiment, the secondary compartment 24*a* can be directly sewn to the insulating structure 100. An opening 102 is provided in the housing through which the secondary compartment 24*a* extends. In this regard, the assembled version of the carrier 20*a* is essentially the same as the carrier 20 as shown in FIG. 1. The only difference will be that the secondary compartment 24 will be directly attached to the insulating structure 100 rather than to the wall of the housing 28.

While a preferred embodiment of the present invention is shown and described, it is envisioned that those skilled in the art may devise various modifications and equivalents without departing from the spirit and scope of the invention as defined by the appended claims. The invention is not intended to be limited by the foregoing disclosure.

The invention claimed is:

1. A portable carrier comprising:

a rigid housing defining a primary compartment, the housing having a recessed area and an insulating material, the primary compartment being thermally insulated by the insulating material;

an auxiliary storage assembly in connection with said housing for retaining an article on said housing externally of said primary compartment, said auxiliary storage assembly including a ledge and a retainer, wherein said article abuts said ledge and is retained against said housing by said retainer;

a secondary storage compartment attached to said housing externally of said primary compartment, said secondary storage compartment being formed of a flexible material and including a closure to provide access to the contents of said secondary storage compartment and to secure the contents of said secondary storage compartment as necessary; and an article retention assembly attached to said housing externally of said primary compartment, said article retention assembly including a generally elastic panel portion attached over a portion of the recessed area of said housing, at least a portion of one edge of said panel defining an opening between said edge and said recessed area for receiving a further article therethrough, the further article disposed through said opening being retained between the recessed area of said housing and an interior surface of said panel;

wherein one portion of said one edge is confined within the boundaries defined by said recessed area.

2. A carrier as recited in claim 1, said ledge being formed in a further recessed area of said housing.

3. A carrier as recited in claim 1, further comprising a shoulder strap attached to said housing.

4. A carrier as recited in claim 1, further comprising a shoulder strap attached to said housing, said strap having a first and second end being attached to said housing at spaced apart locations generally parallel to said second storage compartment.

5. A carrier as recited in claim 1, further comprising a shoulder strap attached to said housing, said strap having a first and second end being attached to said housing at spaced apart locations generally parallel to said article retention assembly.

6. A carrier as recited in claim 1, wherein the insulating material is insulating foam beads.

7. A carrier as recited in claim 1, wherein the insulating material is a formed insulating body.

8. A carrier as recited in claim 1, wherein the insulating material is a formed-in-place foam material.

9. A portable carrier comprising:

a housing having a first and a second recessed external surface and an insulating material, the housing defining a primary compartment, the primary compartment being thermally insulated by the insulating material;

an auxiliary storage assembly in connection with said housing for retaining an article on said housing externally of said primary compartment, the auxiliary storage assembly being at least partially defined by the first recessed external surface;

a secondary storage assembly attached to said housing externally of said primary compartment, said secondary storage compartment being formed of a flexible material and including an inlet to provide access to the contents of said secondary storage compartment; and an article retention assembly attached to said housing externally of said primary compartment, said article retention assembly including a generally elastic panel portion attached over a portion of the second recessed external surface of said housing, at least a portion of one edge of said panel defining an opening between said edge and said second recessed external surface for receiving a further article therethrough, the further article disposed through said opening being retained between the second recessed external surface of said housing and an interior surface of said panel;

wherein one portion of said one edge is confined within the boundaries defined by said second recessed external surface.

10. A carrier as recited in claim 9, wherein the auxiliary storage assembly is further defined by a ledge for supporting the article and a retainer for retaining the article against said housing.

11. A carrier as recited in claim 9, further comprising a shoulder strap attached to said housing.

12. A carrier as recited in claim 9, further comprising a shoulder strap attached to said housing, said strap having a first and second end being attached to said housing at spaced apart locations generally parallel to said second storage compartment.

13. A carrier as recited in claim 9, further comprising a shoulder strap attached to said housing, said strap having a first and second end being attached to said housing at spaced apart locations generally parallel to said article retention assembly.

14. A carrier as recited in claim 9, wherein the insulating material is insulating foam beads.

15. A carrier as recited in claim 9, wherein the insulating material is a formed insulating body.

16. A carrier as recited in claim 9, wherein the insulating material is a formed-in-place foam material.

* * * * *